US006499157B1

(12) United States Patent
McCain et al.

(10) Patent No.: US 6,499,157 B1
(45) **Date of Patent: *Dec. 31, 2002**

(54) MATTRESS COVERINGS AND METHODS OF MAKING

(75) Inventors: Ricky A. McCain, Monroe, NC (US); Jack V. Dockery, Jr., Waxhaw, NC (US); John W. Whitley, Monroe, NC (US)

(73) Assignee: Perfect Fit Industries, Inc., Monroe, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/317,562

(22) Filed: May 24, 1999

Related U.S. Application Data

(63) Continuation-in-part of application No. 08/976,718, filed on Nov. 24, 1997, now Pat. No. 5,996,148, which is a continuation-in-part of application No. 08/850,959, filed on May 5, 1997, now abandoned, which is a continuation of application No. 08/673,899, filed on Jul. 1, 1996, now Pat. No. 5,625,912.

(51) Int. Cl.[7] ..... A47G 9/04; A47G 9/02

(52) U.S. Cl. ..... 5/497; 5/502

(58) Field of Search ..... 5/497, 500, 502, 5/482, 495, 496; 297/224

(56) References Cited

U.S. PATENT DOCUMENTS

| | | | |
|---|---|---|---|
| 286,037 | A | 10/1883 | Mayall |
| 750,780 | A | 1/1904 | O'Brien |
| 1,462,279 | A | 7/1923 | Guinzburg |
| 1,825,909 | A | 10/1931 | Levi |
| 2,045,630 | A | 6/1936 | Bratman |
| 2,066,428 | A | 1/1937 | Straus |
| 2,122,892 | A | 4/1938 | Hardie et al. |
| 2,142,336 | A | 1/1939 | Selinger |

(List continued on next page.)

FOREIGN PATENT DOCUMENTS

| | | | |
|---|---|---|---|
| CA | 508069 | 12/1954 | |
| DE | 28 00 586 A1 | 7/1979 | |
| DE | 36 35 417 A1 | 4/1988 | |
| EP | 0425466 | 5/1991 | ..... 5/497 |
| FR | 2694177 | 2/1994 | ..... 5/497 |
| GB | 701899 | 1/1954 | |
| GB | 891355 | 3/1962 | |
| JP | 3244415 | 2/1990 | |

OTHER PUBLICATIONS

*Sears Catalog*, Fall/Winter, 1981, .p. 1427.

(List continued on next page.)

*Primary Examiner*—Alexander Grosz
(74) *Attorney, Agent, or Firm*—Akin, Gump, Straus, Hauer & Feld, L.L.P.

(57) ABSTRACT

A mattress covering in the form of a fitted mattress pad or fitted sheet has an inelastic, generally rectangular top portion and a skirt of inelastic material extending transversely, preferably perpendicularly from the outer periphery of the top portion in a closed loop entirely around the outer periphery of the top portion. A first elastic cord is secured to the skirt at its outer periphery remote from the top portion. A second, separate elastic cord is secured to the skirt at some place between and spaced apart from the top panel portion and the first elastic cord, preferably closer to the top portion outer periphery than to the first elastic cord. The skirt can be made of two layers of a textile material, each layer being a single panel, or it can be made of multiple panels or lengths of other materials for each layer. The two skirt layers are attached to each other and either or both elastic members can be attached to either or both of the inelastic fabric layers by surface bonding, particularly by ultrasonic spot welding. The top portion is dimensioned to fit a standard size mattress and the skirt is dimensioned to fit a range of mattress heights.

10 Claims, 9 Drawing Sheets

U.S. PATENT DOCUMENTS

| | | | | |
|---|---|---|---|---|
| 2,162,755 | A | | 6/1939 | Shauer |
| 2,197,188 | A | | 4/1940 | Lilley |
| 2,245,779 | A | | 6/1941 | Heil ..... 5/499 |
| 2,302,259 | A | | 11/1942 | Rothfuss |
| 2,414,927 | A | | 1/1947 | Chapman |
| 2,528,313 | A | | 10/1950 | Kessler |
| 2,569,627 | A | | 10/1951 | Black ..... 5/497 |
| 2,605,483 | A | | 8/1952 | Ridenhour |
| 2,624,893 | A | | 1/1953 | Harris |
| 2,696,872 | A | | 12/1954 | Kurland et al. |
| 2,778,412 | A | | 1/1957 | Trubitt |
| 2,793,683 | A | | 5/1957 | Trubitt |
| 2,865,615 | A | | 10/1958 | Cirocco |
| 2,942,280 | A | | 6/1960 | May, Jr. ..... 5/497 |
| 3,020,566 | A | | 3/1962 | Anderson et al. ..... 5/497 |
| 3,142,072 | A | | 7/1964 | Goodson, Jr. |
| 3,181,179 | A | | 5/1965 | Roddey, Jr. |
| 3,273,175 | A | | 9/1966 | Anderson et al. |
| 3,290,702 | A | | 12/1966 | Seltzer |
| 3,795,019 | A | | 3/1974 | Fragas |
| 3,906,559 | A | | 9/1975 | Bahr |
| 3,999,233 | A | | 12/1976 | Morris |
| 4,042,986 | A | | 8/1977 | Goodman et al. |
| 4,081,301 | A | * | 3/1978 | Buell ..... 2/401 |
| 4,422,195 | A | | 12/1983 | Russo et al. |
| 4,606,964 | A | | 8/1986 | Wideman |
| 4,651,370 | A | | 3/1987 | Vitale ..... 5/497 |
| 4,672,702 | A | | 6/1987 | Isham ..... 5/497 |
| 4,682,555 | A | | 7/1987 | Bierbaum et al. |
| 4,703,530 | A | | 11/1987 | Gusman ..... 5/497 |
| 4,704,753 | A | | 11/1987 | Lunt |
| 4,727,608 | A | | 3/1988 | Joyce |
| 4,734,947 | A | | 4/1988 | Vitale |
| 4,742,788 | A | | 5/1988 | Dugan |
| 4,744,118 | A | | 5/1988 | Lunt |
| 4,756,942 | A | | 7/1988 | Aichele |
| 4,757,564 | A | | 7/1988 | Goodale |
| 4,801,482 | A | | 1/1989 | Goggans et al. |
| 4,841,588 | A | | 6/1989 | Harbin et al. |
| 4,962,546 | A | | 10/1990 | Vitale ..... 5/497 |
| 4,980,941 | A | | 1/1991 | Johnson, III ..... 5/497 |
| 4,985,953 | A | | 1/1991 | Seago ..... 5/497 |
| 5,046,207 | A | | 9/1991 | Chamberlain ..... 5/497 |
| 5,127,115 | A | | 7/1992 | Williams et al. ..... 5/497 |
| 5,271,112 | A | | 12/1993 | Bible et al. |
| 5,325,555 | A | | 7/1994 | Whitley ..... 5/500 |
| 5,530,979 | A | | 7/1996 | Whitley ..... 5/500 |
| 5,625,912 | A | | 5/1997 | McCain et al. ..... 5/497 |
| 5,636,393 | A | | 6/1997 | Zafiroglu ..... 5/497 |
| 5,996,148 | A | | 12/1999 | McCain et al. |

OTHER PUBLICATIONS

*Sears Catalog*, Spring/Summer, 1983, p. 1258.

*Sears Catalog*, Fall/Winter, 1984, p. 1454.

*Sears Catalog*, Welcome America .. . . , p. 1179.

"Sack–ette" box spring cover, Perfect Fit Industries, Inc., Monroe, NC, 1980, two photocopy sheets (of inner and outer sides at transverse seam).

Package Insert No. 913864 for *Flexwall Bedsack Mattress Pad,* Perfect Fit Industries, Inc., Monroe, N.C., Feb., 1993.

* cited by examiner

MATTRESS COVERINGS AND METHODS OF MAKING

RELATED APPLICATIONS

The present application is a continuation-in-part of U.S. patent application Ser. No. 08/976,718 filed Nov. 24, 1997 now U.S. Pat. No. 5,996,148, which is a continuation-in-part of U.S. patent application Ser. No. 08/850,959 filed May 5, 1997 (now abandoned), which is a continuation of Ser. No. 08/673,899, filed Jul. 1, 1996, now U.S. Pat. No. 5,625,912.

BACKGROUND OF THE INVENTION

The present invention relates generally to mattress coverings, such as mattress pads and sheets, and, more particularly, to relatively inexpensive, fitted mattress coverings capable of practical and effective use with mattresses of a standard top surface sizes and a range of heights.

Fitted mattress pads and sheets are commonly available in various forms. The simplest form is one having the top portion and a side skirt formed of the same piece of material and having an elastic strap or cord located around the lowermost periphery of the side skirt to draw the lowermost end of the covering under the mattress and to attempt to retain the covering in a fitted condition on the mattress. Such coverings have the advantages of ease of manufacture and a consistent appearance with the sides being of the same material as the top. They have the disadvantage, however, of having only a single elastic band along their lowermost periphery to retain an otherwise inelastic covering on mattresses which are being sold more frequently in varying heights, including relatively significant heights of one foot or more. They have a further disadvantage of being expensive to manufacture if the top panel material, which is typically a higher quality textile material such as a quilted material or a higher thread count cotton or cotton blend material, extends down along the sides of the covering sufficiently to cover the sides of mattresses of the greatest heights (thicknesses) currently being sold, so that the coverings can be used with mattresses of a given predetermined top size (e.g. standard, queen, king, etc.) regardless of the mattress height (thickness).

The variation and overall increase in heights of mattresses has led to the introduction of another form of fitted mattress covering, a mattress pad that has a quilted top and a side skirt made of another material. The side skirt is a foot or more in height to cover the sides of all or at least substantially all mattresses being sold and is elasticized over its entire height. In addition, a heavier elastic band or strap or cord (hereinafter collectively "cord") is also attached to the lowermost periphery of the skirt as with the original coverings. Such pads have been made with skirts formed by joining with a conventional, inelastic textile material layer, a layer of a special, non-woven, elastic sheet material. Such pads have also been made with side skirts formed from a single layer of inelastic material, which is elasticized by being stitched with multiple (e.g. six or more) uniformly spaced parallel rows of elastic threads sewn into the otherwise inelastic, single skirt material layer. Such pads have also been made using side skirt material which is itself knitted or woven from elastic thread.

All three forms of skirt construction offer elasticity over the full height of the skirt. It has been found that providing elasticity over the full height of the skirt provides a neat, gathered appearance and improves mattress cover retention due to the ability of the elasticized material to grip the side walls of the mattress in addition to any gripping provided by the elastic cord around the lowermost periphery of the skirt.

It has further been found that an acceptable degree of fit and retention of mattress pads can be achieved if some of the length of the side skirt of the mattress pad extending from the top is provided by a band of inelastic material closely fitted to the sides of the mattress. This band can be provided by supplying a one-piece, rectangular top portion with four rectangular panels extending from the edges of the top portion. The panels are turned transversely to the top portion and seamed together forming an upper portion of the side skirt. A second band of elasticized inelastic material is attached to the lower periphery of the upper skirt portion to complete the skirt. The lower band is elasticized as noted above by bonding to a band of inelastic fabric, a layer of a non-woven, elastomeric material coextensive with the band, or by stitching several rows of elastic thread into the band or by providing a band knitted or woven from elastic threads. Again, a heavier elastic cord is attached to the lower most periphery of the second band as with the other mattress coverings. It has been found that an upper skirt portion seamed at four corners so as to provide a closed loop of inelastic material extending generally perpendicularly to the top portion of the pad and closely fitting around a mattress on which the pad is mounted, combined with the relatively lighter elastic grip of the lower band of elasticized material and traditionally heavier elastic cord around the bottom of the skirt, also provided a sufficient grip along the height of the skirt for such covers to remain in place when used with mattress of varying heights.

While there are other differences among these mattress coverings, at least one factor which is significant in distinguishing these constructions from one another is their cost of manufacture. This factor is becoming ever more important as a significant portion of the commercial market for these coverings is controlled primarily if not exclusively by price. Thus, the least expensive construction of such covers which still provides an appearance and gripping performance acceptable to distributors and consumers, is very valuable.

SUMMARY OF THE INVENTION

In one aspect, the invention is a mattress covering adapted for fitted disposition over the top, sides, ends and corners of mattresses of standard top surface sizes comprising an inelastic, generally rectangular top portion having an outer periphery dimensioned to at least substantially cover the top surface of mattresses of at least one predetermined standard top surface size; a side skirt formed, apart from any seams, from two layers of inelastic textile material joined with the outer periphery of the generally rectangular top portion and extending transversely from the outer periphery of the top portion around the entire outer periphery of the top portion in a closed loop, the two layers of inelastic textile material being ultrasonically welded to each other; a first elastic cord secured with the side skirt and extending at least partially around a periphery of the side skirt remote from the top portion; and a second elastic cord secured between the two layers of the side skirt so as to impart elasticity to the two layers, the second elastic cord further being located between and spaced apart from the first elastic cord and the outer periphery of the top portion.

In another aspect, the invention is a mattress covering adapted for fitted disposition over the top, sides, ends and corners of mattresses of standard top surface sizes comprising an inelastic, generally rectangular top portion having an outer periphery dimensioned to at least substantially cover the top surface of mattresses of at least one predetermined standard top surface size; a side skirt formed by two pieces of inelastic textile material joined with the outer periphery of the top portion and extending transversely from the outer periphery of the generally rectangular top portion around the entire outer periphery of the top portion in a closed loop, the two pieces of inelastic textile material being ultrasonically welded to each other; a first elastic cord secured with the side skirt and extending at least partially around a periphery of the side skirt remote from the top portion; and a second elastic cord secured between the two pieces of inelastic material so as to impart elasticity to the inelastic side skirt material, the second elastic cord further being located between and spaced apart from the first elastic cord and the outer periphery of the top portion.

In yet another aspect, the invention is a mattress covering adapted for fitted disposition over the top, sides, ends and corners of mattresses of standard top surface sizes comprising an inelastic, generally rectangular top portion having an outer periphery dimensioned to at least substantially cover the top surface of mattresses of at least one predetermined standard top surface size; a side skirt formed, apart from any seams, from at least one layer of inelastic textile material joined with the outer periphery of the generally rectangular top portion and extending transversely from the outer periphery of the top portion around the entire outer periphery of the top portion in a closed loop; and at least a first elastic cord surface bonded with at least the one layer of the inelastic material of the side skirt and extending at least partially around the side skirt spaced apart from the top portion.

In yet another aspect, the invention is a mattress covering adapted for fitted disposition over the top, sides, ends and corners of mattresses of standard top surface size comprising an inelastic, generally rectangular top portion having an outer periphery dimensioned to at least substantially cover the top surface of mattresses of at least one predetermined standard top surface size; a side skirt formed by at least one piece of inelastic textile material joined with the outer periphery of the generally rectangular top portion and extending transversely from the outer periphery of the generally rectangular top portion around the entire outer periphery of the top portion in a closed loop; and at least a first elastic cord surface bonded with at least the one piece of the inelastic textile material of the side skirt and extending at least partially around the side skirt spaced away from the top portion.

In yet another aspect, the invention is a method of manufacturing a mattress covering comprising the steps of drawing a first layer of an inelastic textile material and a second layer of an inelastic textile material in a first direction of travel while stretching a plurality of spaced apart elastic cords between the first layer and the second layer; connecting the first layer with the second layer and the cords with at least one of the two layers; severing the connected layers into a plurality of strips generally parallel to the elastic cords, a first elastic cord being located along a first edge of each strip, and a second elastic cord being located between and spaced apart from the first elastic cord and a second edge of each strip opposing the first edge; cutting each strip to a desired length; and attaching the second edge of each strip to an outer periphery of an inelastic, generally rectangular top portion having an outer periphery dimensioned to at least substantially cover the top surface of mattresses of at least one predetermined standard top surface size, the strip extending transversely from the outer periphery of the top portion around the entire outer periphery of the top portion in a closed loop.

BRIEF DESCRIPTION OF THE DRAWINGS

The foregoing summary, as well as the following detailed description of preferred embodiments of the invention will be better understood when in conjunction with the appended drawings. For the purpose of illustrating the invention, there is shown diagrammatically in the drawings, embodiments which are presently preferred as well as other alternate embodiments. It should be understood, however, that the invention is not limited to the specific methods and instrumentalities disclosed. In the drawings.

DETAILED DESCRIPTION OF THE PREFERRED EMBODIMENTS

Figure 1:
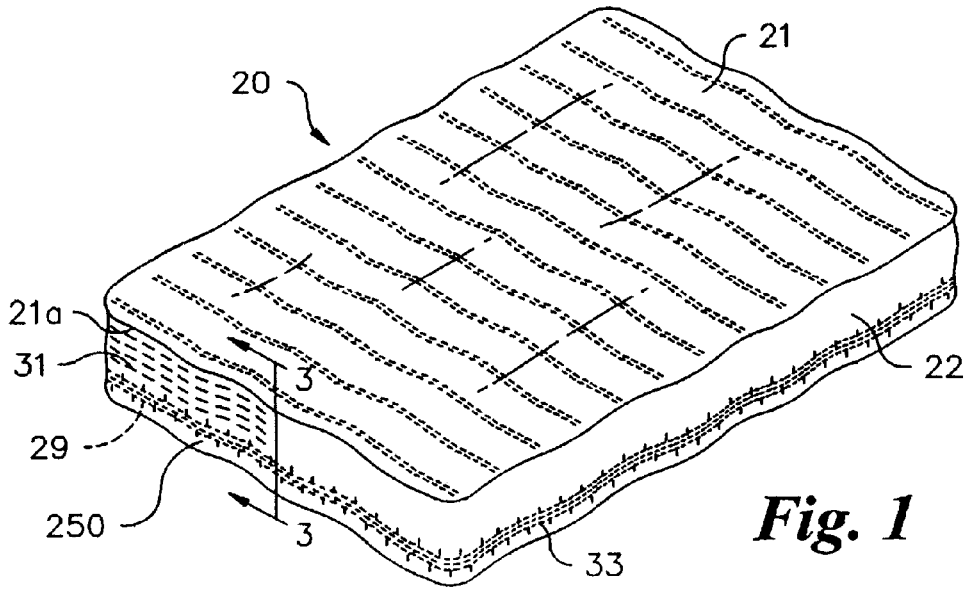
FIG. 1 is a perspective view of a mattress on which one form of the preferred embodiment of the mattress covering of the present invention is fitted.

Initially, U.S. Pat. Nos. 4,734,947, 4,801,482, 4,962,546, 5,325,555, 5,530,979 and 5,625,912 and application Ser. No. 08/976,718 now U.S. Pat. No. 5,996,148 are incorporated herein in their entireties by reference.

One preferred embodiment mattress covering of the present invention is illustrated in FIGS. 1–7. In this form, the mattress covering is a mattress pad 20 adapted for fitted disposition over the top, sides, ends and corners of mattresses of standard top surface sizes (e.g. single, twin, double, queen, etc. including standard, non-U.S. sizes). Pad 20 has an inelastic, generally rectangular and planar top portion 21 preferably of a conventional, multi-layer, quilted pad material. A side skirt 22 preferably is formed, apart from any seams, by two separate pieces 122, 222 of inelastic textile material, which are joined with and extend transversely, preferably perpendicularly, from the outer periphery 21*a* of the generally rectangular top portion 21, around the entire outer periphery 21*a* of the top portion, in a closed loop. Each of the pieces 122, 222 may be of one or more plies but is preferably of a single layer. An "upper" periphery of the side skirt 22, which is proximal to the top portion 21, is attached to the outer periphery 21*a* of the top panel portion by suitable means such as by overlapping and sewing together the edges of the pieces of material 21, 22 along their adjoining peripheries with conventional, non-elastic thread or by bonding. Side skirt 22 has a "lower" or "outer " or "remote" periphery 22*a,* which is located on a side of the side skirt 22 remote from the top portion 21 and opposite the periphery of the side skirt 22 proximal to and joined with the top portion periphery 21*a*.

Figure 3:
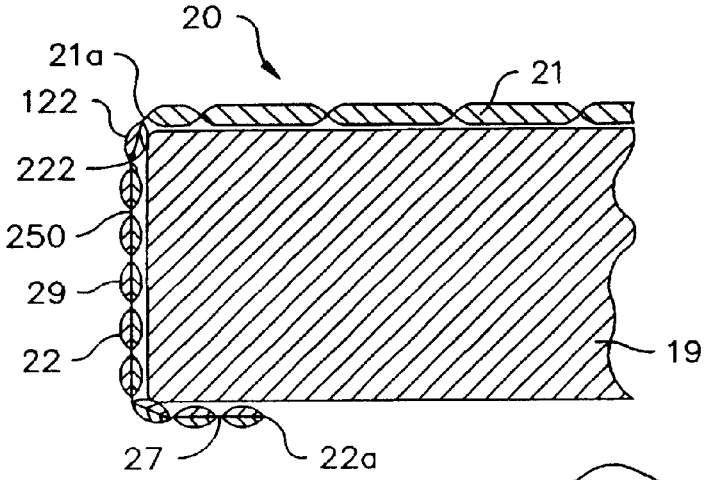
FIG. 3 is a partial vertical sectional view taken along line 3—3 of FIG. 1.

Skirt layer 122 is connected to skirt layer 222 by surface bonding the skirt layers 122, 222 together along their lengths, preferably by ultrasonic spot welding the skirt layers 122, 222 together at spots 250, as shown in FIGS. 1 and 3. Spot welds 250 are indicated only along line 3–3 of FIG. 1 for clarity of other features of the pad 20. Other forms of surface bonding including adhesive layer(s), solvent welds and thermal welds and combinations thereof (with or without ultrasonic welds) might be used.

Preferably located between skirt layers 122, 222 and extending at least partially around the lower periphery 22*a* of the side skirt 22, remote from the top portion 21, is a first elastic cord 27 of a type conventionally used in bedding. Cord 27 is secured to the remote periphery 22*a* of the inelastic side skirt 22, at a "free" edge of the inelastic side skirt 22 spaced apart from the top portion 21. Preferably, the cord 27 is surface bonded along its length to at least one layer and, more preferably, both layers 122, 222 of the inelastic textile material of the side skirt 22. While the first elastic cord 27 preferably extends entirely or at least essentially entirely around the remote or lower periphery 22*a* of side skirt 22, it will be appreciated that the first elastic cord 27 may only extend partially around the outer periphery 22*a* and may be supplied in one piece or in two or more pieces which may be spaced apart from one another around the periphery 22*a*. The first elastic cord 27 is secured to the otherwise inelastic skirt material so as to impart elasticity to the two layers 122, 222 at periphery 22*a*. Preferably, the first elastic cord 27 is secured, in particular, by ultrasonic spot welding to the layer(s).

A second elastic cord 29 of a type conventionally used in bedding preferably is secured between skirt layers 122, 222 and is located on the side skirt 22 between and spaced apart, preferably spaced away from the outer periphery 21 a of the top panel portion 21 and the remote periphery 22*a* of the inelastic side skirt 22 with the first cord 27. The second elastic cord 29 is secured to at least one and preferably both of the two layers 122, 222 so as to impart elasticity to the inelastic side skirt material at a location between and apart from the top portion and remote periphery of the skirt. Preferably, the second elastic cord 29 is secured by surface bonding, in particular, ultrasonic spot welding to the layer(s). Preferably, the first elastic cord 27 and the second elastic cord 29 extend generally parallel to one another. Preferably, the first elastic cord 27 and the second elastic cord 29 extend entirely around the side skirt 22. Also preferably, the second elastic cord 29 is the only elastic member between the top portion outer periphery 21*a* and the first elastic cord 27. Finally, the longitudinal ends of the two pieces of the skirt layers 122, 222 forming side skirt 22 and the ends of elastic cords 27 and 29 are joined together in any appropriate manner, such as by stitching, bonding, etc., preferably defining a vertical seam 23 at one comer of the top portion 21 such that skirt 22 and cords 27, 29 all form closed loops around the periphery 21*a* of top portion 20. The side skirt material may be layered on itself at any seams.

Puckers 31 in the inelastic textile material are generally shown as a series of single, vertical dashed lines in FIG. 1. Seams 33 in the surface bonding between the elastic cord 29 and the skirt layers 122, 222 are generally shown as a series of horizontal dashes in FIG. 1 on either side of the elastic cord 29 (shown in phantom).

Figure 2:
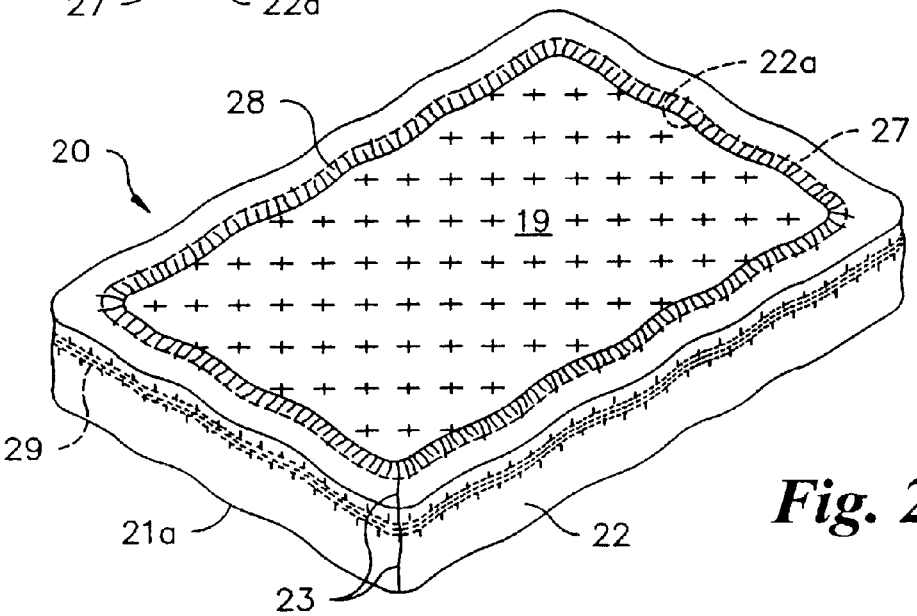
FIG. 2 is a perspective view of the mattress and covering of FIG. 1 as viewed looking toward the bottom of the mattress and covering.

As is illustrated in FIGS. 1, 2 and 3, the mattress pad 20 is fitted on a mattress 19 of at least one predetermined standard top surface size (e.g. twin, full, standard, queen, king, western or California king, etc.). The outer periphery 21*a* of the top portion 21 of the mattress pad 20 is dimensioned to at least substantially, if not essentially cover the entire top surfaces of all mattresses of one "standard" top surface size, recognizing that there may be variations between the exact dimensions of mattresses provided in the "standard" sizes by different manufacturers, as well as acceptable manufacturing variations in such "standard" top sizes for each manufacturer. The top portion should have a length and width at least as great as that of the smallest mattresses known to be sold for a given standard size or an otherwise generally recognized "nominal" industry standard for that mattress size.

Suggestedly, the side skirt 22 has a height dimension between the top portion 21 and its own lower or remote periphery 22*a* of at least a foot and preferably about fourteen inches or more. Preferably too, the second elastic cord 29 is suggestedly located between about four (4) and about eight (8) inches from the outer periphery 21*a* of the top panel portion 21, preferably five to seven inches from the outer periphery 21*a*. In the United States, mattress heights currently range from less than about five inches to about fourteen inches or more. An "intermediate" height range of that total range currently would be between about eight and about eleven inches, for example. Thus, the second elastic cord 29 is located at a height to extend under only the thinnest of mattresses heights and to otherwise extend around and grip the side walls of most other mattresses. Despite the provision of a side skirt 22 formed from an inelastic material a foot or more in height, the mattress pad 20 is capable of practical and effective use on mattresses over a relatively wide range of heights with the provision of only the two elastic cords 27 and 29 along the full width of the side skirt.

Figure 4:
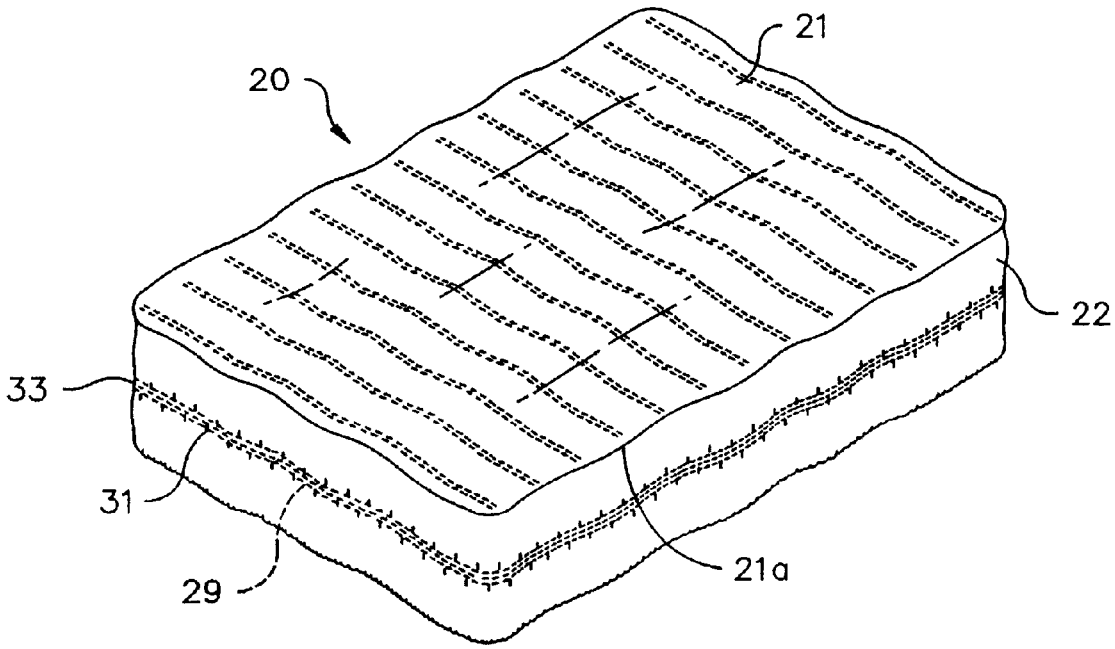
FIG. 4 is a perspective view showing the mattress covering of FIG. 1 fitted on a mattress of a higher height than the mattress of FIG. 1.
Figure 5:
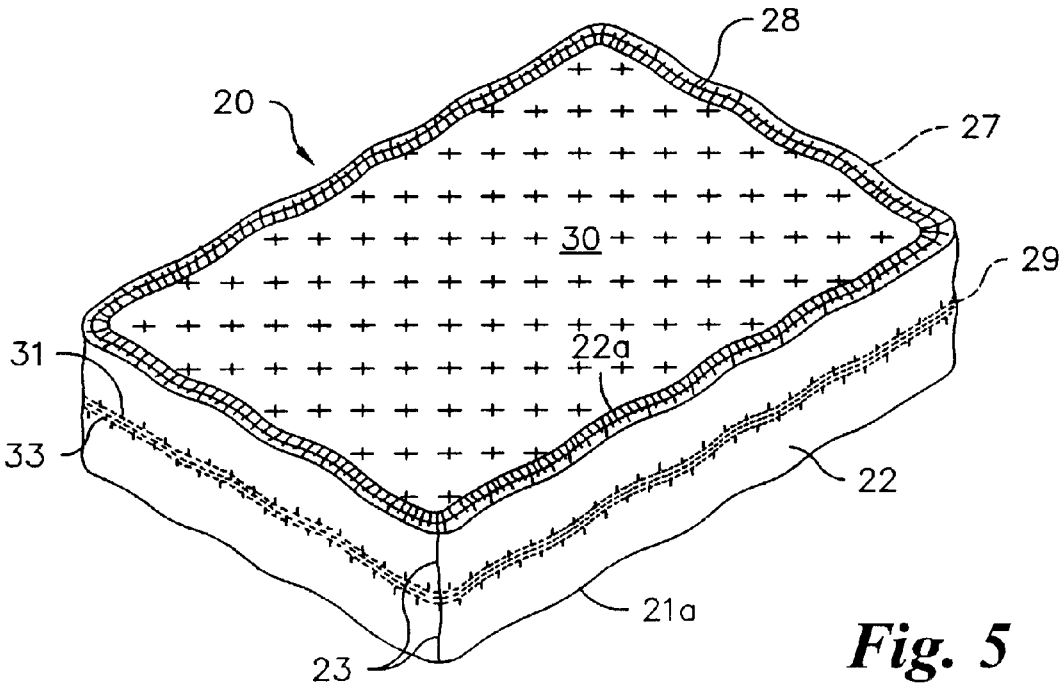
FIG. 5 is a perspective view of the mattress and covering of FIG. 4 as viewed looking toward the bottom of the mattress.

The same mattress pad 20, which is shown on an intermediate height mattress 19 in FIGS. 1, 2 and 3 (e.g. about eight to eleven inches), is shown in FIGS. 4 and 5 (spot welds not shown for clarity) fitted on a mattress 30 having a thickness (height) corresponding to the generally greatest thickness (ie., greatest height) of the standard range of heights for the mattress size for which the pad is adapted. In this installation, the side skirt 22 of pad 20 extends downwardly, at least substantially if not entirely covering the mattress sides and ends and, as shown in FIGS. 4 and 5, and may even continue under the mattress 30 an extent sufficient to permit the lowermost elastic cord 27 to draw the open bottom of the skirt 22 of mattress pad 20 into fitted relation beneath the mattress 30 and to retain the pad 20 on the mattress 30. If the mattress is thicker (taller) than the height ("width") of the side skirt 22, as may occur with the very thickest of current mattresses or with future, thicker mattresses, then both of the first and second elastic cords 27 and 29 will span and grip only the vertical sides and ends of the mattress 30 to retain the mattress pad 20 in position on the mattress 30. Only the lowermost inch or so of the side skirt 22, which is puckered from the presence of the lowermost elastic cord 27, extends entirely under the mattress.

Figure 6:
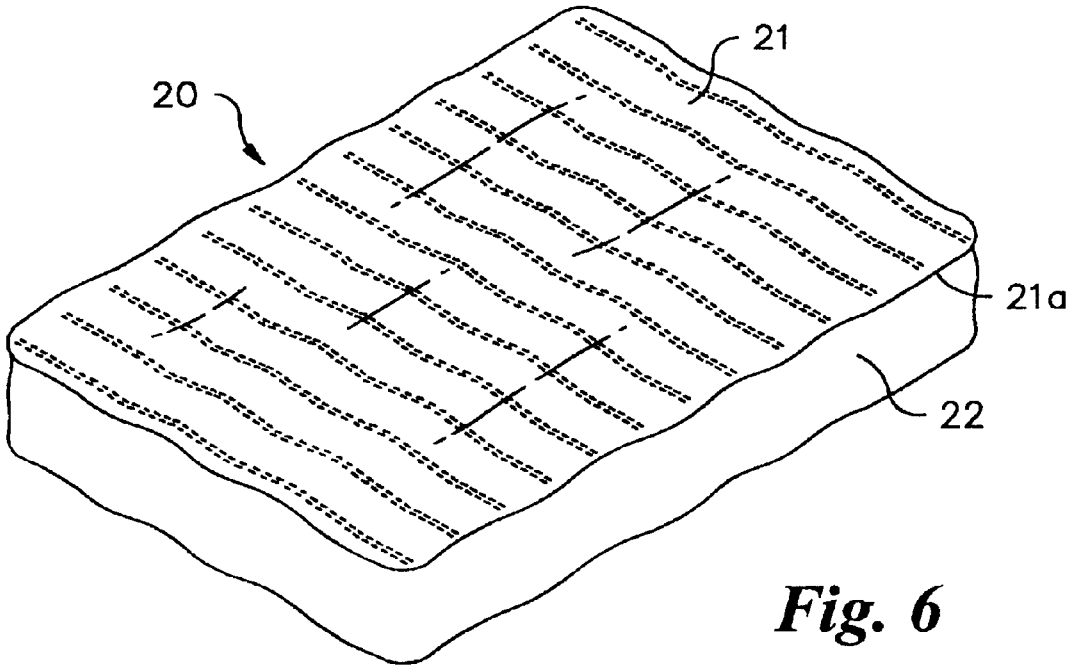
FIG. 6 is a perspective view of the mattress covering of FIG. 1 fitted on a mattress of a lower height than the mattress of FIG. 1.
Figure 7:
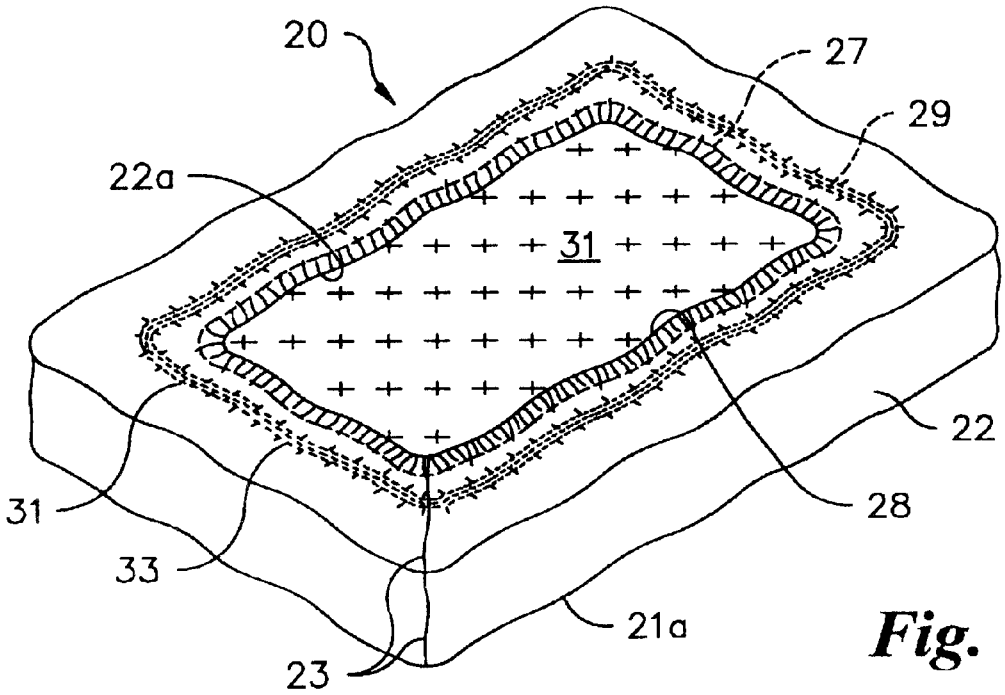
FIG. 7 is a perspective view of the mattress and covering of FIG. 6 as viewed looking toward the bottom of the mattress.

In FIGS. 6 and 7 (spot welds again not shown for clarity), the same mattress pad 20 is illustrated fitted on a mattress 31 of a thickness corresponding generally to the thinnest (lowest mattress height) portion of the standard range of heights for the mattress size on which the pad 20 is adapted to be used. In this installation, the side skirt 22 extends from the top panel portion 21*a* distance greater than the height of the mattress 31 and, therefore, partially extends under the mattress 31, being drawn under by the second or intermediate elastic cord 29. The first, or lowermost elastic cord 27 extends even further under the mattress 31 to draw the lowermost end of side skirt 22 deeper under the mattress 31 and the mattress pad 20 into a more completely wrapped around position better fitted on the mattress 31.

Figure 8:
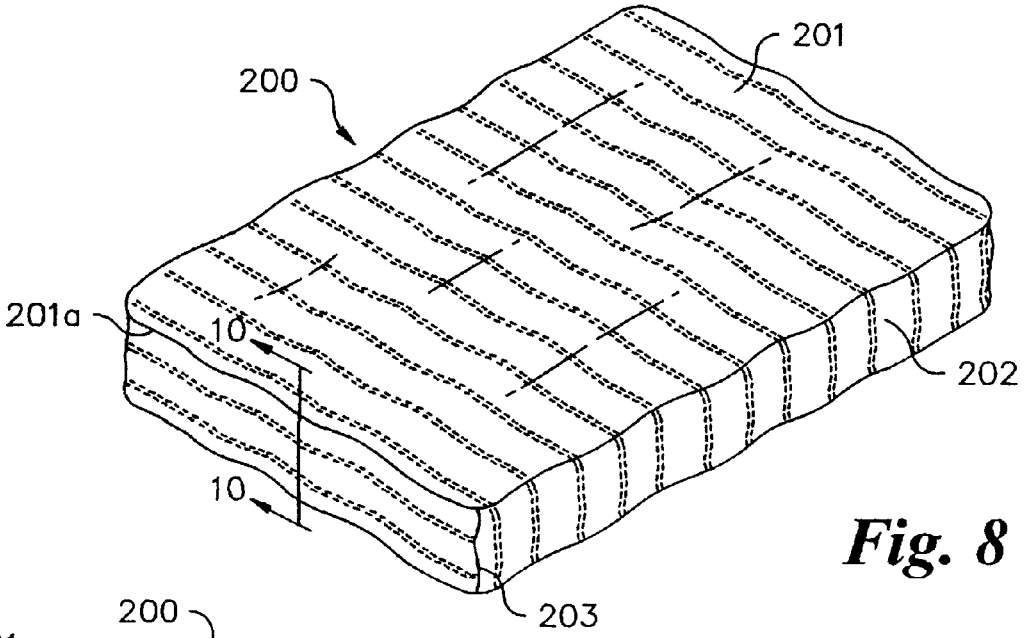
FIG. 8 is a perspective view of a mattress covering of another form of the preferred embodiment of the present invention fitted on a mattress.
Figure 10:
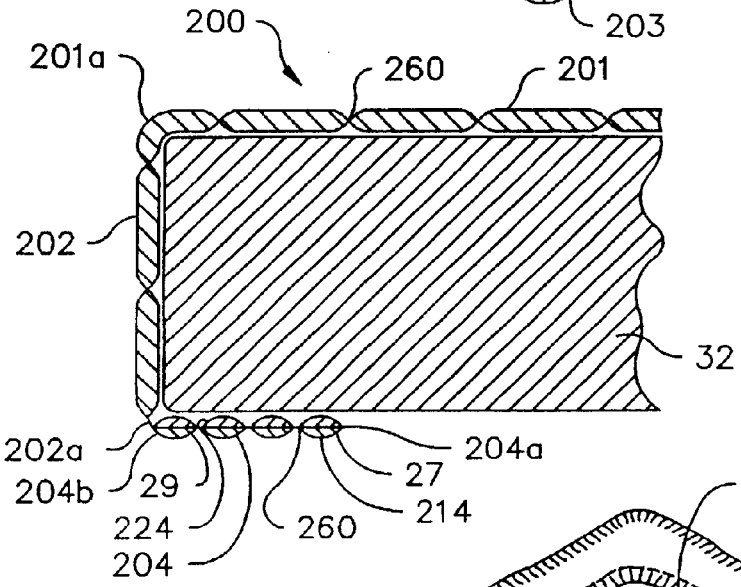
FIG. 10 is a partial vertical sectional view taken along line 10—10 of FIG. 8.
Figure 9:
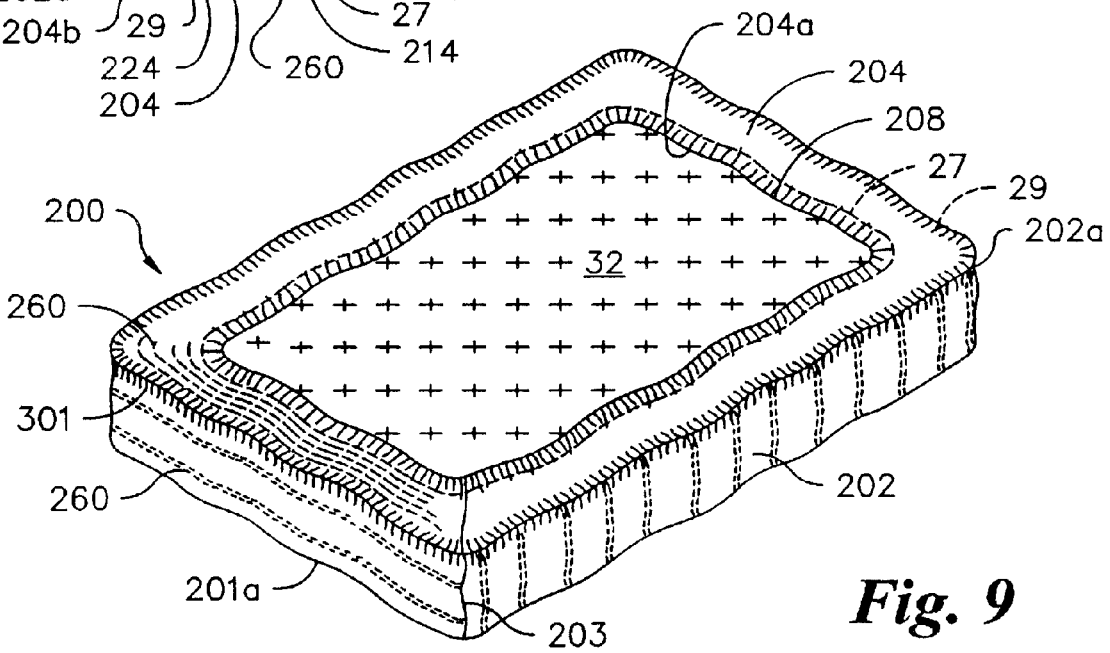
FIG. 9 is a perspective view of the mattress and covering of FIG. 8 as viewed looking toward the bottom of the mattress.

Another of the preferred embodiments of the mattress covering of the present invention is illustrated in FIGS. 8–10. In this form, the mattress covering is a mattress pad 200 adapted for fitted disposition over the top, side, ends and corners of mattresses of predetermined standard top surface sizes. Pad 200 has an inelastic, generally rectangular and planar top panel portion 201 of conventional, preferably quilted pad material. Preferably an inelastic side skirt 202 is formed of the same material integrally with the top portion 201. The side skirt 202 extends entirely around and transversely away from the outer periphery 201 a of top portion 201. Side skirt 202 preferably is formed with corners, preferably seamed as at 203, that extend transversely and preferably at least generally perpendicularly and straight from the "corners" of the outer periphery 201 a of the generally rectangular top portion 201 to fit closely over the corners, sides and ends of a mattress. Side skirt 202 has a "lower" periphery 202*a,* which is on a side of the side skirt 202 remote from the top portion 201. Secured to and extending around and away from the lower periphery 202*a* of the side skirt 202 is a separate inelastic panel defining an inelastic underskirt 204. As illustrated in the embodiments, the inelastic underskirt 204 is preferably formed from two layers 214, 224 of inelastic textile fabric, which may be of natural fiber, a synthetic material or a blend and woven or non-woven. An "upper" periphery of the underskirt 204, which is proximal to the side skirt 202, is attached to the outer periphery 202*a* of the side skirt portion by suitable means such as by overlapping and sewing together the edges of the pieces of material 202, 204 along their adjoining peripheries with conventional, non-elastic thread or by bonding. Underskirt 204 has a "lower" or "outer" or "remote" periphery 204*a,* which is located on a side of the underskirt 204 remote from the side skirt 202 and opposite the periphery of the underskirt 204 proximal to and joined with the side skirt periphery 202*a*.

Skirt layer 214 is connected to skirt layer 224 by surface bonding the skirt layers 214, 222 together along their lengths, preferably by ultrasonic spot welding the skirt layers 214, 224 together at spots 260, as shown in FIG. 10. A portion of the spots 260 are also shown in FIG. 9. A remainder of the spot welds 260 are omitted from FIG. 9 for clarity of the remaining features. Other forms of surface bonding including adhesive layer(s), solvent welds and thermal welds and combinations thereof (with or without ultrasonic welds) might be used.

Preferably located between skirt layers 214, 224 and extending at least partially around the lower periphery 204*a* of the underskirt 204, remote from the top portion 201, is a first elastic cord 27 of a type conventionally used in bedding. Cord 27 is secured to the remote periphery 204*a* of the inelastic underskirt 204, at a "free" edge of the inelastic underskirt 204. Preferably, the cord 27 is spot welded along its length to at least one layer and preferably both layers 214, 224 of the inelastic material of the underskirt 204. While the first elastic cord 27 preferably extends entirely or at least essentially entirely around the remote or lower periphery 204*a* of underskirt 204, it will be appreciated that the first elastic cord 27 may only extended partially around the outer periphery 204*a* and may be supplied in one piece or in two or more pieces which may be spaced apart from one another around the periphery 204*a* The first elastic cord 27 is thus secured to the otherwise inelastic skirt material so as to impart elasticity to the two layers 214, 224 at periphery 204*a*.

A second elastic cord 29 of a type conventionally used in bedding preferably is secured between skirt layers 214, 224 and is spaced apart from, preferably spaced away from, the first cord 27 and top portion outer periphery 201*a*. More particularly, cord 29 is preferably located on the underskirt 204, at an edge 204*b* of the underskirt 204, attached to the lower periphery 202*a* of the side skirt 202 and away from the first cord 27. The second elastic cord 29 is secured to at least one and preferably both of the two layers 214, 224 so as to impart elasticity to the inelastic underskirt material 204 at a location between the side skirt 202 and the underskirt 204. Preferably, the second cord 29 is secured by surface bonding, in particular, ultrasonic spot welding to the layer (s). Preferably, the first elastic cord 27 and the second elastic cord 29 extend generally parallel to one another. Preferably, the first elastic cord 27 and the second elastic cord 29 extend entirely around the underskirt 204. Also preferably, the second elastic cord 29 is the only elastic member between the top portion outer periphery 201*a* and the first elastic cord 27. Finally, the longitudinal ends of the two pieces of the skirt layers 214, 224 forming underskirt 204 and the ends of elastic cords 27 and 29 are joined together in any appropriate manner, such as by stitching, bonding, etc., preferably defining a seam 203 at one corner of the top portion 201 such that side skirt 202, underskirt 204 and cords 27, 29 all form closed loops around the periphery 201*a* of top portion 200. The underskirt material may be layered on itself at any seams. Puckers 301 in the inelastic textile material are generally shown as a series of singly, vertical dashed lines in FIG. 9.

Despite the provision of an inelastic side skirt 202 with an inelastic underskirt 204, the mattress pad 200 is capable of practical and effective use on standard top size mattresses within a relatively wide range of heights by the provision of at least the lowermost cord 27 and preferably the two elastic cords 27 and 29. As discussed above in the embodiment of FIGS. 1–3, the mattress pad 200 is fitted on a mattress 19 of at least one standard top surface size (e.g. twin, full, queen, king, western or California king, etc.). The outer periphery 201*a* of the top portion 201 of the mattress pad 200 is dimensioned to cover the top surface of mattresses of a standard top surface size by having length and width dimensions at least substantially if not essentially the same as the predetermined standard length and width top surface dimensions of the standard size mattress on which the pad is to be used. Preferably, the side skirt 202 has a width dimension between the top portion 201 and inelastic underskirt 204 (i.e., extends downwardly from the top portion 201 an extent) at least equal to a width dimension of the underskirt 204 and preferably substantially the same as a height of an intermediate height mattress 32 within a predetermined standard range of heights as discussed above in reference to FIGS. 1–7.

The top and the sides of the mattress pad 200 are formed with the same attractive, preferably quilted material, which preferably extends down only to the bottom of the side walls of the intermediate height mattress 32, with the underskirt 204 being hidden under the mattress. This reduces the amount of quilted material that must be used in making the mattress pad 200 of this particular size and provides an underskirt 204 of sufficient width to effectively draw the mattress pad 200 into fitted disposition with the mattress 32 and the straight corners 203 fitting neatly at the corners of the mattress 32. The underskirt 204 may be a lesser quality, less attractive sheet of textile material such as a nylon scrim, or other similar type fabric, and is preferably used for mattress pads which will be used on mattresses such as those shown in FIGS. 2 and 7, where little or no portion of the lower skirt will be visible when the mattress pad is installed on those types of mattresses.

Figure 11:
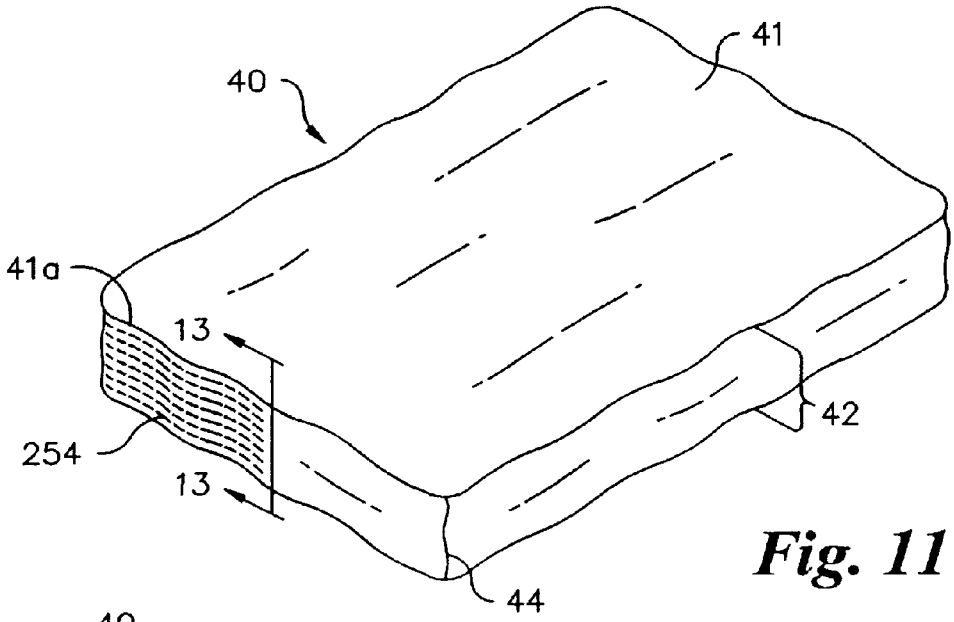
FIG. 11 is a perspective view of a mattress covering of a further form of the preferred embodiment of the present invention fitted on a mattress.
Figure 13:
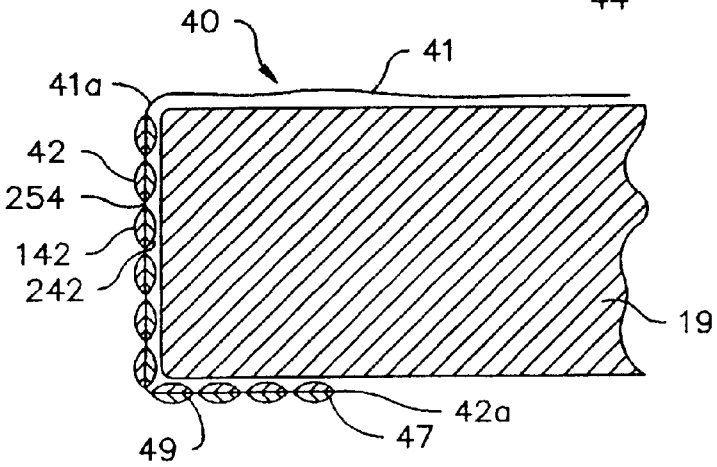
FIG. 13 is a partial vertical sectional view taken along line 13—13 of FIG. 11.
Figure 12:
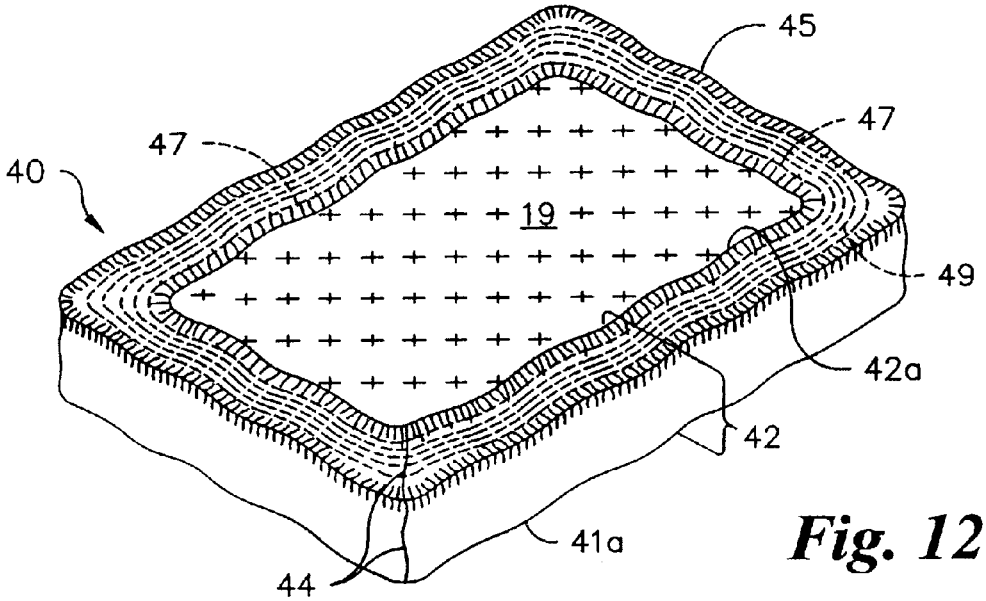
FIG. 12 is a perspective view of the mattress and covering of FIG. 11 as viewed looking toward the bottom of the mattress.

Mattress coverings of the present invention can also take the form of a fitted sheet as well as a mattress pad. The form of a preferred embodiment as a fitted sheet 40 is illustrated in FIGS. 11, 12 and 13. In this embodiment, the fitted sheet 40 has a top portion 41 with outer periphery 41*a* having dimensions generally the same as the predetermined dimensions of the top surface of a mattress of the standard size on which the sheet 40 is to be used to at least substantially cover top surfaces of mattresses of at least that one standard top surface size. This top portion 41 is formed preferably of a single piece of a single layer of a conventional, inelastic woven or nonwoven textile sheet material. A side skirt 42 is preferably formed by two layers of an inelastic material 142, 242 which extend integrally from the outer periphery 41*a* of the top portion 41, respectively. If corners are seamed into the side skirt 42 as shown, the seamed corners 44 extend at least trasnsversely and, preferably, generally perpendicularly and generally straight from the generally rectangular top portion 41.

Skirt layer 142 is connected to skirt layer 242 by surface bonding the skirt layers 142, 242 together along their lengths, preferably by ultrasonic spot welding the skirt layers 142, 242 together at spot welds 254, as shown along line 13—13 in FIG. 11 and in FIG. 13. The remaining spot welds are omitted for clarity. Other forms of surface bonding including adhesive layer(s), solvent welds and thermal welds and combinations thereof (with or without ultrasonic welds) might be used.

A first elastic cord 47 is secured with the lower outer periphery 42*a* of the side skirt 42, remote from the outer periphery 41*a* of the top panel portion 41. Cord 47 extends at least partially and preferably entirely around the lower outer or free periphery 42*a* of the side skirt 42 while a second elastic cord 49 is secured with the sheet 40 between and spaced apart from the top portion outer periphery 41*a* and the side skirt outer periphery 42*a,* preferably as noted above with respect to the first mattress pad embodiment, to facilitate retention of the sheet 40 in fitted disposition on any of the mattresses 19, 30, 31.

An alternate embodiment of a fitted sheet (not shown) is similar to the embodiment of the mattress pad 200 shown in FIGS. 8–10, with preferred single piece of a single layer of a conventional, inelastic woven or nonwoven textile sheet material being substituted for the top portion 201 and side skirt portion 202 and the multilayer skirt of the embodiment of FIGS. 11–13 provided as an underskirt in the manner of mattress pad 200 of FIGS. 8–10.

Figure 14:
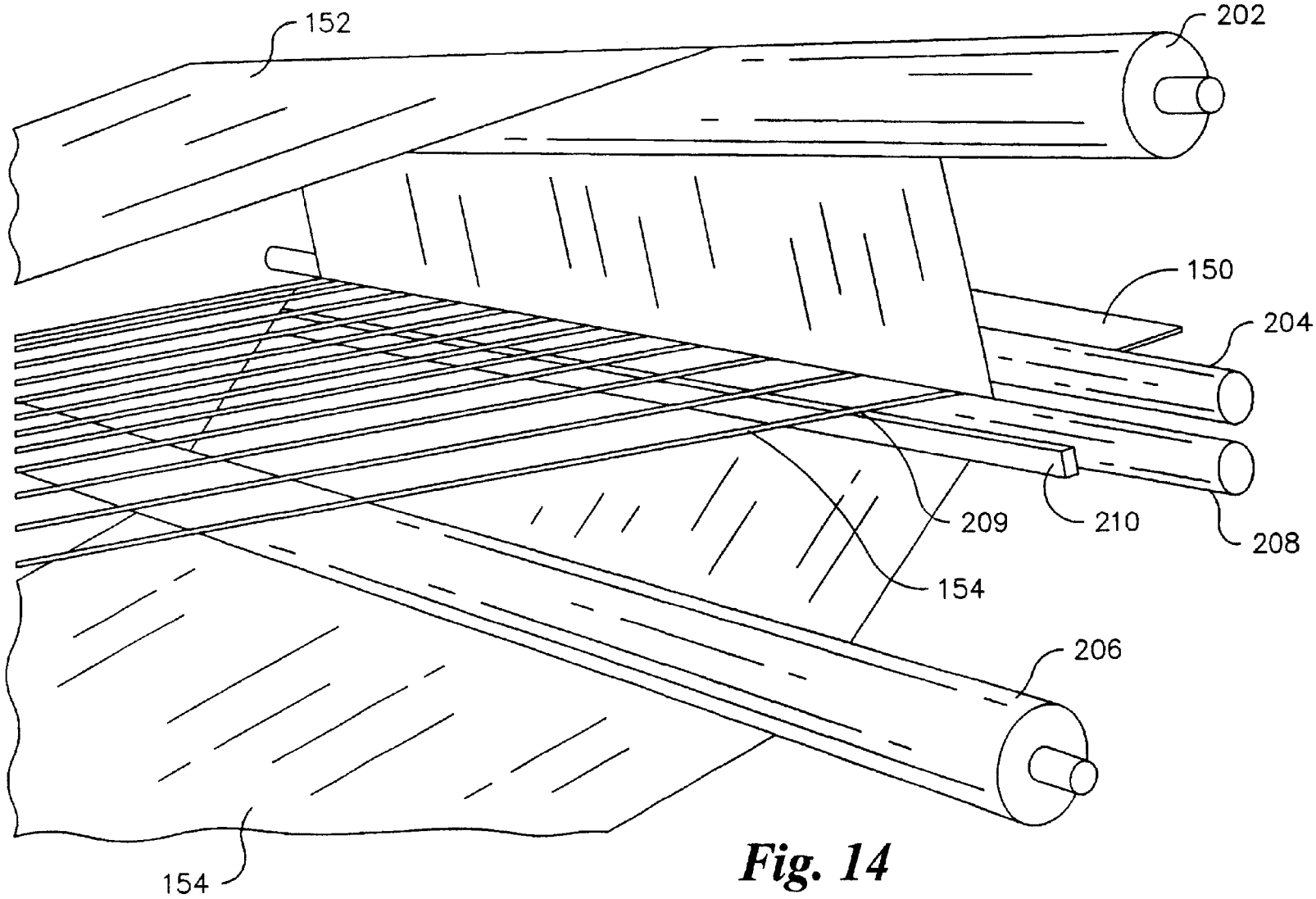
FIG. 14 is a perspective view of the layers and elastic cords of side skirt material being joined together.

The preferred method of making mattress coverings according to the present invention includes initially preparing a continuous, preferably layered side skirt (or underskirt) preferably bearing the two elastic cords secured thereto and therebetween. Multilayer skirts can be conveniently made automatically by machine in significant continuous lengths. As shown in FIG. 14, a first layer 152 of an inelastic textile material and a second layer 154 of the inelastic textile material are drawn in a common direction of travel. Rollers 202, 204 direct the travel of the first layer 152 while rollers 206, 208 direct the travel of the second layer 154. The first layer 152 and the second layer 154 are brought together in the nip between rollers 204 and 208 to form a bonded assembly 150. Simultaneously, a plurality of spaced apart elastic cords 156 are stretched between the first layer 154 and the second layer 154, sandwiching the elastic cords 156 between the layers 152, 154. Spacing between the elastic cords 156 is maintained by spacers 209 provided on spacer bar 210 to also stretch the cords. The spacers 209 are fixed at predetermined locations along the spacer bar 210 corresponding to desired distances between elastic cords 156 in the bonded assembly 150. The elastic cords 156 are put under tension at the spacer bar 210, preferably stretched to at least two and a half times of unstretched length, although those skilled in the art will realize that the elastic cords 156 can be stretched to other lengths. After the first layer 152 is brought into contact with the second layer 154, the first layer 152 is connected to the second layer 154 and the cords 156 are connected with at least one and preferably both of the two layers 152, 154. Preferably, the first and second layers 152, 154 and elastic cords 156 are all surface bonded together, preferably spot welded together, and, more preferably, ultrasonically spot welded together into a multilayer assembly 150.

Preferably, layers 152, 154 are rolled over a rotating welding drum (not shown) located downstream of rollers 206, 208, with one of the layers 152, 154 contacting the drum. The welding drum includes a raised pattern spaced about the outer circumference of the drum. An ultrasonic horn (not shown) is located proximate to the outer circumference of the drum. The ultrasonic horn vibrates at a high frequency, preferably at approximately one hundred kilohertz. The vibration from the horn heats the raised pattern as the drum rotates. As the layers 152, 154 are passed over the drum, some of the heat from the raised pattern is transferred to the layers 152, 154 at the locations where the one of the layers 152, 154 contacts the raised pattern. The heat is transferred to the one of the contacting layers 152, 154, melting both the one of the layers 152, 154, the other of the layers 152, 154, and any elastic cord 156 or other layer (not shown) located between layers 152, 154. Alternatively, those skilled in the art will realize that other methods, such as using a multi-head quilting machine or an ultrasonic sewing machine can be used to bond the layers 152, 154 to each other.

Figure 15:
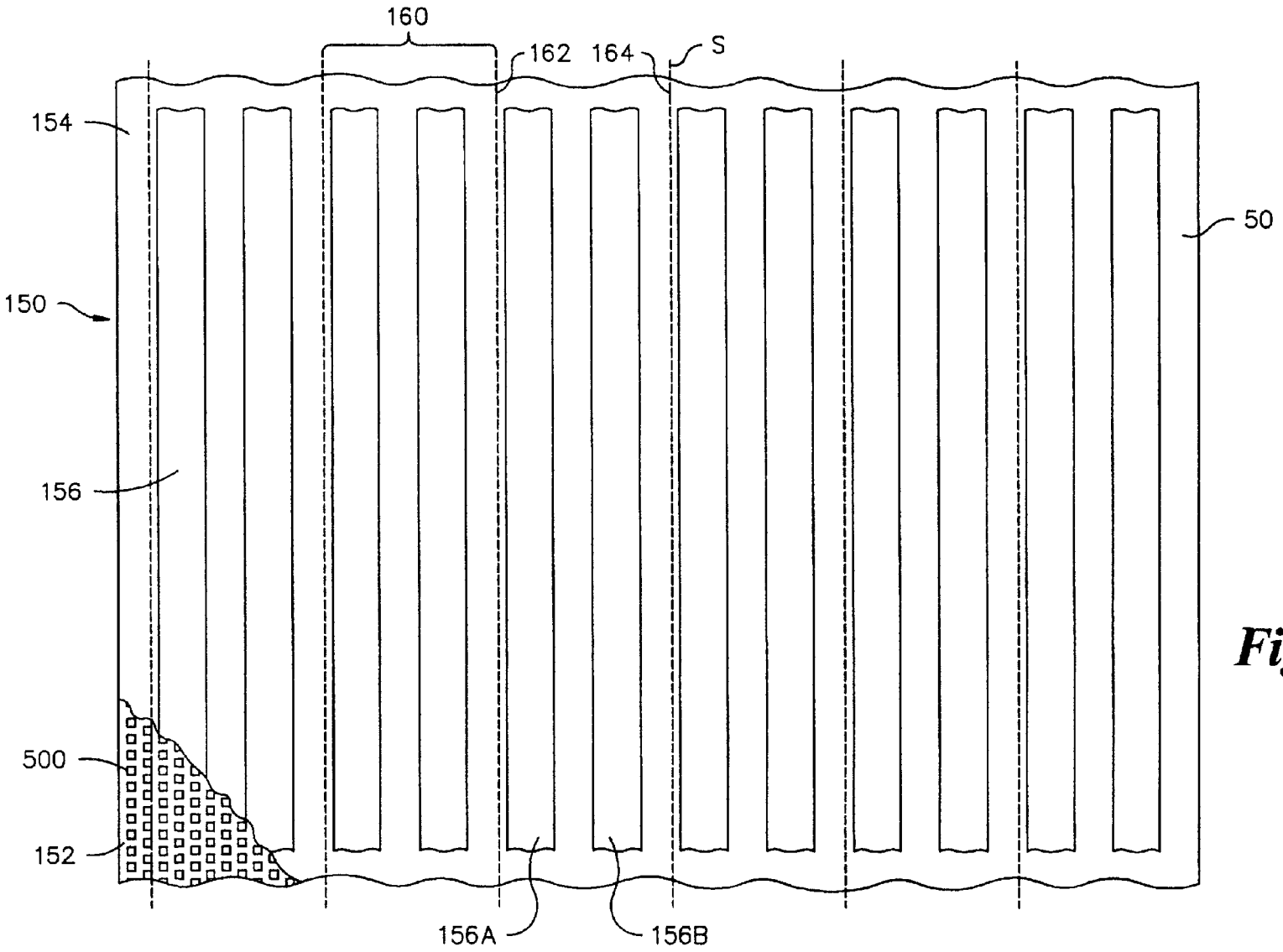
FIG. 15 is a top plan, partially broken away view of a first arrangement of the joined layers and cords of FIG. 14 being divided into individual skirt widths.

As shown in one possible embodiment depicted in FIG. 15, a plurality of elastic cords 156 are spaced along the width of and preferably between the layers 152, 154, each elastic cord 156 being generally equidistant from its adjacent elastic cord 156. After the layers 152, 154 and cords 156 are connected, the layers 152, 154 of the assembly 150 are severed into a plurality of identical strips 160 generally parallel to the elastic cords 156. Preferably, at least six identical strips 160 are formed from the assembly 150, although those skilled in the art will realize that either more or fewer than six strips 160 can be formed. The combined layers 152, 154 are severed along broken lines "S", which extend proximate to edges of alternate elastic cords 156, shown in FIG. 15, such that an elastic cord 156A is located proximate to a first edge 162 of a severed strip 160 and an adjacent elastic cord 156B is located generally halfway between and spaced apart from near edge of cord 156A on the first edge 162 of the severed strip 160 and a second opposing edge 164 of the severed strip, although those skilled in the art will realize that elastic cord 156B can be located at other locations between the first edge 162 of the severed strip 160 and the second opposing edge 164 of the severed strip. Preferably, the first edge 162 is located about one eighth of an inch from the elastic cord 156A. Preferably, the assembly 150 is severed along line S with an ultrasonic knife (not shown) which seals layer 152 to layer 154. The about one eighth of an inch of the assembly 150 and provides a clean edge of the strip 160.

Figure 16:
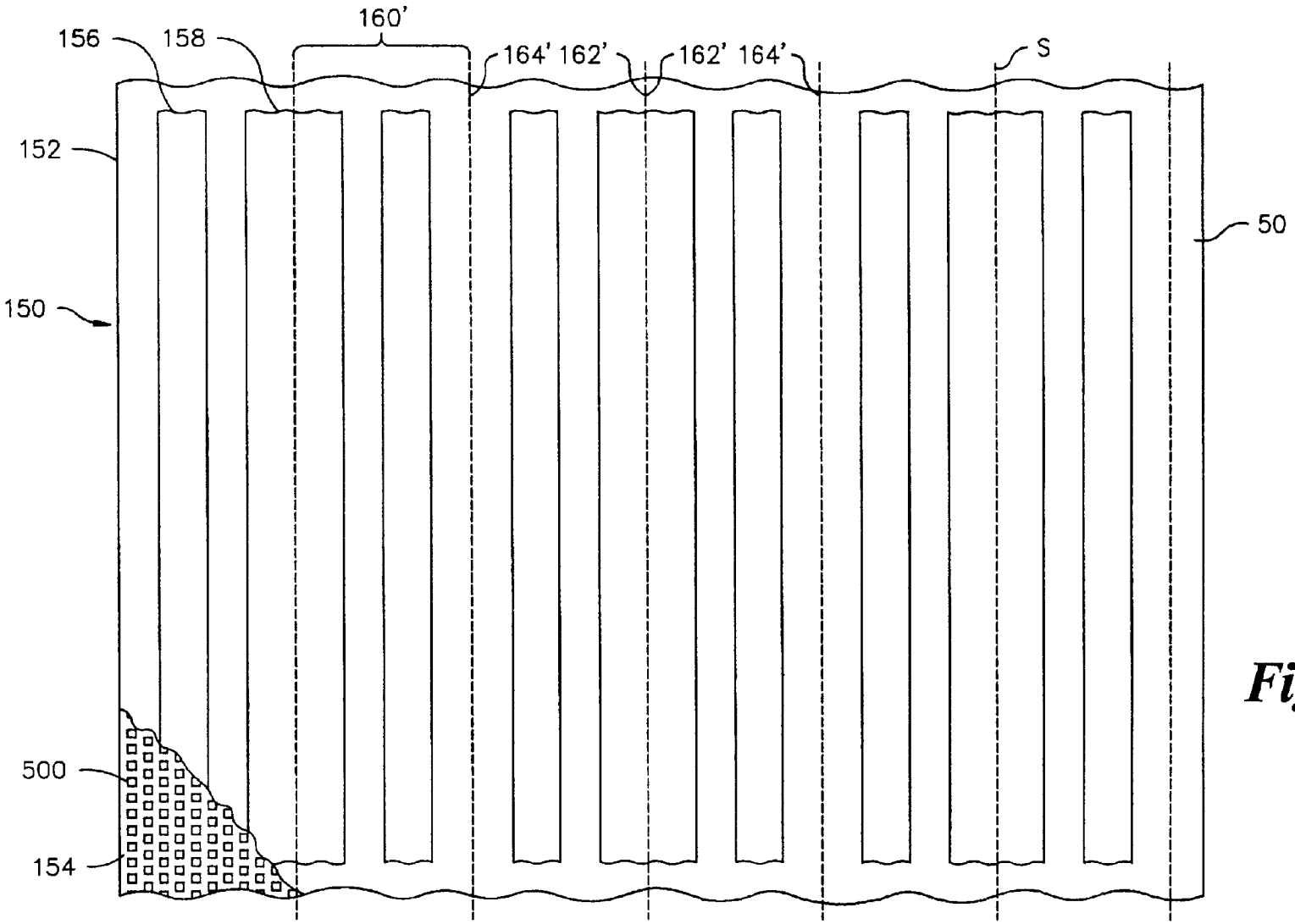
FIG. 16 is a top plan, partially broken away view of a second arrangement of the joined layers and cords of FIG. 14 being divided into individual skirt widths in an alternate form than that shown in FIG. 15.

Alternatively, as shown in FIG. 16, some of the elastic cords can be twice the width of the remaining elastic cords. In this arrangement, two narrower elastic cords 156 are located between each consecutive pair of wider elastic cords 158, with a distance between each narrower size elastic cord 156 being roughly twice the distance between each narrower elastic cord 156 and its adjacent wider elastic cord 158. A narrower cord 156 is also located between each of the outermost positioned wider cords 158 and the longitudinal edges of the assembly. The severing is performed such that the wider elastic cords 158 are severed along their longitudinal centerlines and the layers 152, 154 are severed generally halfway between the adjacent spaced apart narrower elastic cords 156. In this severing arrangement, each length of the formerly wider elastic cord 158 forms part of a first edge 162' of the severed sheet 160' and ultimately an edge of a side skirt remote from a mattress covering top portion and each newly severed edge of the layers 152, 154 forms a second edge 164' of the side skirt.

Alternatively, the cords of the second embodiment assembly 150' can all be of the same width (156 or 158) and each alternate cord split as in FIG. 16 to create a pair of narrower cord portions running along one edge of each of two resulting strips like cut cord 158 along edge 162' in FIG. 16.

Figure 17:
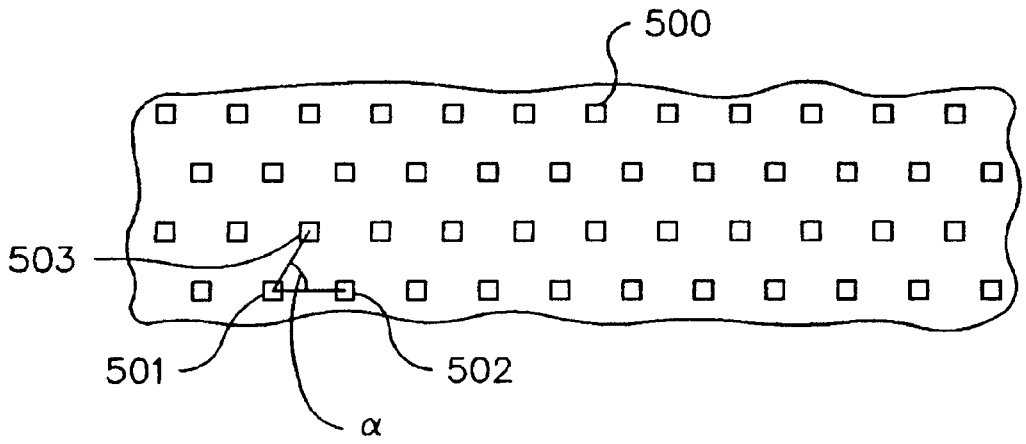
FIG. 17 is a detailed view of a pattern of spot welds on the skirt securing the two layers and elastic cords together.

FIG. 17 shows one possible pattern of spot welds 500 on the skirt securing two layers together. Preferably, each spot weld 500 is approximately 2/32" (1.59 mm) long by 1/32" high (0.79mm). The spot welds 500 in FIG. 17 are regularly or uniformly positioned in rows, with approximately 4/32" (3.18 mm) of unwelded layer 122, 222 between each spot weld 500. Each row is approximately 7/32" (5.56 mm) apart from each adjacent row. The spot welds 500 in each row are approximately evenly spaced between two proximate spot welds 500 in each adjacent row. As shown in FIG. 17, an angle $\alpha$ is formed between a line joining two co-linear spot welds 501, 502 and one of the co-linear spot welds 501 with the spot weld 503 proximate both co-linear spot welds 501, 502 from an adjacent row. Preferably, the angle $\alpha$ is between approximately 50° and 70°. Those skilled in the art will realize that other distances and angles and arrangements can be used without departing from the scope and spirit of the present invention.

Figure 18:
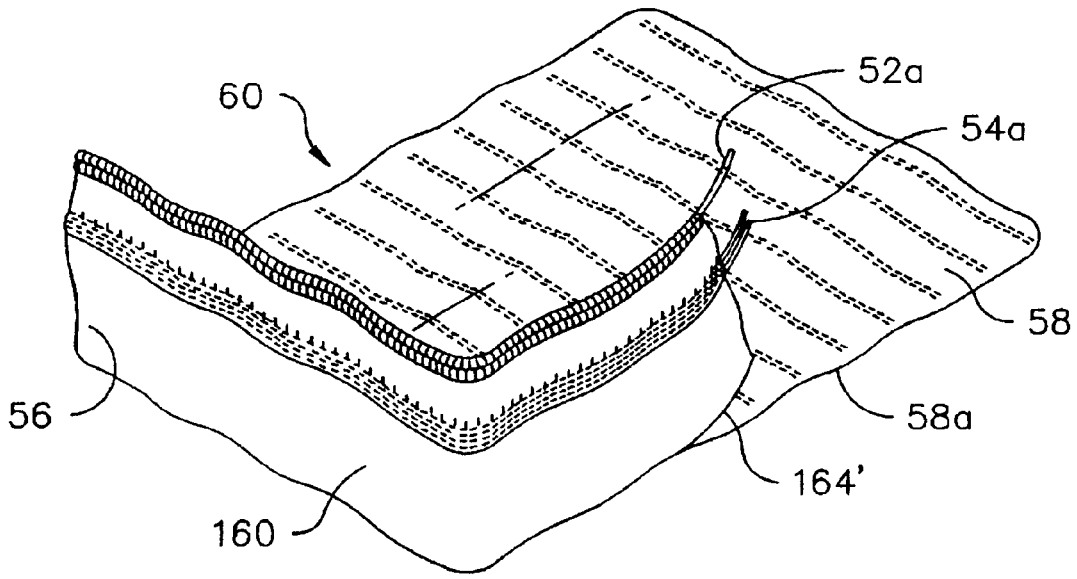
FIG. 18 is a perspective view of a mattress covering being fabricated by attaching a side skirt to a generally rectangular piece of material.

Referring now to FIG. 18, after severing, the second cut edge 164 (or 164') of each strip 160 (or 160') used as a side skirt 56 is attached along the outer periphery 58*a* of an inelastic, generally rectangular and planar, fabric panel forming a top portion 58, to form a mattress covering 60 of the present invention like the covering 20 of FIGS. 1–7 or 40 of FIGS. 11–13. The ends of the strip forming the skirt 56 are brought together, preferably at one of the corners of the top panel portion 58, and are joined by being sewn together, preferably sewing together at the same time the ends of the first elastic cord 52*a* and the ends of the second elastic cord 54*a*, such that the attached strip extends transversely from the outer periphery of the top portion around the entire outer periphery 58*a* of the top portion 58 in a closed loop. Each strip 160, 160' is cut to a desired length generally perpendicular to the elastic cords 52*a*, 54*a* either before or after the strip is attached to the outer periphery 58*a* of the top portion 58 around the entire outer periphery of the top portion in a closed loop. Preferably, multiple side skirts are formed at the same time as shown in FIGS. 15 and 16 from two continuous length layers 152, 154 of widths of cloth 50 forming the bonded assembly 150 (or 150').

Preferably, the layers 152, 154 are manufactured from polyester, polyblends, Dacron® or any other material capable of melting from the heat generated by the bonding process. Likewise, the elastic cords are preferably wrapped in polyester, polyblends, Dacron® or any other material capable of melting from the heat generated by the bonding process.

The method of construction described above and shown in the figures is preferred for inexpensive manufacture of mattress coverings of the present invention. However, it will be appreciated that the mattress covers of the present invention can be formed in other ways.

Referring back to FIGS. 8–13, separate pieces of inelastic fabric material might be substituted for any or all of the transversely folded panels, which are described above as being provided by edge portions of the one piece of material that also defines the top panel portion of the covering. The material forming the top panel portion may also provide portions of the side skirt on only some of the sides (e.g., ends) of the resulting mattress cover. One or more separate panels would then be joined to the remaining sides or ends of the top panel portion and transversely folded panels, as appropriate, and all stitched or otherwise joined together. Alternatively, a separate length of the same material used for the top portion 201 can be attached to a length of underskirt material and the pair attached to the outer periphery of the top portion around the top portion in a loop.

Preferably all elastic cords extend entirely around the perimeter of the mattress covering. However, it is recognized that one or more of the cords could be extended around only a portion of the covering perimeter or may be provided by several separate portions which collectively extend only part way or entirely around the skirt perimeter to provide further cost saving or to attempt to avoid patent infringement or possibly other reasons. All such constructions are intended to be covered by the present invention.

Elastic cords as referred to in this application are items which are much heavier than ordinary elastic thread and too large to be passed through needles of sewing machines, stitch bonding machines, quilting machines or the like in order to be themselves stitched directly into the skirt material as thread. The cords are preferably straps formed of a single flat strip knitted or woven of elastic thread(s) or elastic and inelastic threads which, after knitting or weaving, are also no longer capable of being passed through a sewing machine. Because they cannot be stitched directly into fabric themselves, some other means (e.g., bonding) must be provided to join them to the skirt material. Preferably, the intermediate (second) cords, which are located between and spaced apart from the outer periphery of the top panel portion and the lower or free edge of the skirt most distal to or remote from the top panel portion, have a thickness dimension and a height dimension which is perpendicular to the thickness dimension and which is greater than the thickness dimension, at least twice, more typically many times greater, desirably at least five and preferably at least ten times greater than the thickness dimension of the strap to lie flat. The height dimension extends in a direction between the outer periphery of the top portion and the periphery of the side skirt remote from the top portion. Such cords are available in a variety of heights and the greater their height, the more area of the mattress they contact and grip.

Suggestedly, the height of the second elastic cord is at least one-quarter inch wide, desirably at least about three-eights inch and preferably at least one-half inch or more wide to firmly grip the mattress and keep the covering in position with little if any movement of the covering on the mattress in normal use. At the same time, the side skirt has a width dimension extending between the outer periphery of the top panel portion of the covering with which the side skirt is joined and the remote free (lower) periphery of the side skirt where the first elastic cord is located, which is many times (more than twice) greater, desirably at least ten and typically twenty or more times greater than the height of the second, intermediate elastic cord member. For example, a woven elastic strap one-half inch wide and about one-twentieth of an inch thick can be bonded between a pair of fourteen inch wide inelastic pieces of textile fabric to provide an elasticized side skirt of the present invention. As is best seen in FIGS. 3, 10 and 13, the elastic cords are joined with the pieces of inelastic side skirt material with the height dimension of the cord parallel to the width dimension of the side skirt, between the skirt layers, to cover and otherwise hide its presence.

It has been found that the provision of a single elastic cord, preferably a conventionally fabricated flat strap, at least one-quarter inch wide, intermediate the edges of the side skirt and preferably closer to the top portion than to the remote free end of the side skirt, will provide a mattress covering which will grip mattresses of substantially all currently supplied heights and extend under most mattresses at least as well as would prior mattress covers which have been made elastic over the full height of their side skirts to be commercially acceptable.

The spot welds can be pseudo-random, that is apparently random over a predetermined length of the skirt (equal to the circumference of the roll providing the welds) or entirely random if a large enough roll is used. Also, the spot welds can be applied in different, repeated patterns, e.g. a scallop, a breaking wave, sinusoidal waves or straight sawtooths running in parallel, etc. to provide a more decorative appearance to the skirt or underskirt, if desired.

The side skirt 22 of mattress pad 20, the underskirt 204 of mattress pad 200 and the side skirt 42 of fitted sheet 40 are disclosed as having two layers 122/222, 204/224, and 142/242, respectively. However, those skilled in the art will realize that at least one intermediate layer (not shown) can be located between layers 122 and 222,204 and 224, and 142 and 242, without departing from the spirit and scope of the present invention. An intermediate layer, if used, can be a bonded fiber, preferably weighing approximately two ounces per square yard. Also, the invention further covers the provision of a mattress covering having a skirt formed by only one layer of inelastic material with the elastic cord(s) spot bonded, preferably ultrasonically spot welded to one major side of the skirt material so that the cord can be seen on that one side of the skirt, preferably the inner side of the skirt facing the mattress, so that the cord is still hidden from view in normal use of the covering.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred and other embodiments, it is to be understood that this disclosure is only illustrative and exemplary of the present invention and is made merely for purposes of provided in a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A mattress covering adapted for fitted disposition over the top, sides, ends and corners of mattresses of standard top surface sizes comprising:

an inelastic, generally rectangular top portion having an outer periphery dimensioned to at least substantially cover the top surface of mattresses of at least one predetermined standard top surface size;

a side skirt formed, apart from any seams, from two layers of inelastic textile material joined with the outer periphery of the generally rectangular top portion and extending transversely from the outer periphery of the top portion around the entire outer periphery of the top portion in a closed loop, the two layers of inelastic textile material being ultrasonically welded to each other;

a first elastic cord secured with the side skirt and extending at least partially around a periphery of the side skirt remote from the top portion; and a second elastic cord secured between the two layers of the side skirt so as to impart elasticity to the two layers, the second elastic cord further being located between and spaced apart from the first elastic cord and the outer periphery of the top portion.

2. The mattress covering of claim 1 wherein the first and second elastic cords extend in parallel to one another.

3. The mattress covering of claim 1 wherein the second elastic cord extends entirely around the side skirt.

4. The mattress covering of claim 1 wherein the first and second cords extend entirely around the side skirt.

5. The mattress covering of claim 1 being a mattress pad, wherein the material forming the top portion is multilayered and quilted.

6. The mattress covering of claim 1 wherein the second elastic cord is the only elastic member between the top portion outer periphery and the first elastic cord.

7. The mattress covering according to claim 6, wherein the second elastic cord is generally flat with a height dimension extending between the outer periphery of the top portion and the periphery of the side skirt remote from the top portion and a thickness dimension perpendicular to the height dimension, the height dimension being at least five times greater than the thickness dimension, and the side skirt having a width dimension generally parallel to the height dimension of the second cord, the width dimension of the side skirt being more than twice as great as the height dimension of the second cord.

8. The mattress covering of claim 1 wherein the side skirt height dimension between the outer periphery of the top portion and the periphery of the side skirt remote from the top portion is at least twelve inches.

9. A mattress covering adapted for fitted disposition over the top, sides, ends and corners of mattresses of standard top surface sizes comprising:

an inelastic, generally rectangular top portion having an outer periphery dimensioned to at least substantially cover the top surface of mattresses of at least one predetermined standard top surface size;

a side skirt formed by two pieces of inelastic textile material joined with the outer periphery of the top portion and extending transversely from the outer periphery of the generally rectangular top portion around the entire outer periphery of the top portion in a closed loop, the two pieces of inelastic textile material being ultrasonically welded to each other;

a first elastic cord secured with the side skirt and extending at least partially around a periphery of the side skirt remote from the top portion; and a second elastic cord secured between the two pieces of inelastic material so as to impart elasticity to the inelastic side skirt material, the second elastic cord further being located between and spaced apart from the first elastic cord and the outer periphery of the top portion.

10. A mattress covering adapted for fitted disposition over the top, sides, ends and corners of mattresses of standard top surface sizes comprising:

an inelastic, generally rectangular top portion having an outer periphery dimensioned to at least substantially cover the top surface of mattresses of at least one predetermined standard top surface size;

a side skirt formed, apart from any seams, from at least one layer of inelastic textile material joined with the outer periphery of the generally rectangular top portion and extending transversely from the outer periphery of the top portion around the entire outer periphery of the top portion in a closed loop, the side skirt including another separate layer of inelastic textile material extending around the entire outer periphery of the top portion and joined with the one layer by spot welds and wherein the one elastic cord extends between the two inelastic layers;

at least one elastic cord surface bonded with at least the one layer of inelastic textile material of the side skirt and extending at least partially around the side skirt spaced apart from the top portion; and another elastic cord positioned between the two layers of the side skirt, the other elastic cord further being spot welded on the side skirt between and spaced apart from the one elastic cord and the outer periphery of the top portion.

* * * * *